US005585712A

United States Patent [19]

Isham

[11] Patent Number: 5,585,712

[45] Date of Patent: Dec. 17, 1996

[54] CURRENT SOURCE WITH SUPPLY CURRENT MINIMIZING

[75] Inventor: Robert H. Isham, Flemington, N.J.

[73] Assignee: Harris Corporation, Melbourne, Fla.

[21] Appl. No.: 195,666

[22] Filed: Feb. 3, 1994

[51] Int. Cl.[6] ..... G05F 3/16; G05F 3/20

[52] U.S. Cl. ..... 323/315; 307/13; 307/43

[58] Field of Search ..... 323/315, 234, 323/268, 266; 363/74, 78; 307/43, 54, 61, 63, 77

[56] References Cited

U.S. PATENT DOCUMENTS

| | | | |
|---|---|---|---|
| 4,963,814 | 10/1990 | Parks et al. | 307/43 X |
| 5,182,462 | 1/1993 | Wright | 323/315 X |
| 5,214,311 | 5/1993 | Kageyama et al. | 307/43 X |
| 5,254,878 | 10/1993 | Olsen | 307/77 X |

*Primary Examiner*—Edward H. Tso
*Attorney, Agent, or Firm*—Joel I. Rosenblatt

[57] ABSTRACT

A set of series connected power supplies are progressively connected to a load as the voltage to the load increases. Starting with a first voltage power supply, as the load voltage increases at or to the first voltage level, a switch connects the next successive power supply in series with the first power supply and to the load. As the load voltage increases progressively approaching each successively connected power supply in the set of series connected power supplies, the load is switched to the next series connected power supply increasing the voltage and current available to the load. As the load voltage decreases progressively from the highest series connected voltage to the voltage of the next lower series connected power supply voltage, the load is switched to that next lower series connected power supply. In operation, a first power supply is connected in series to a plurality of power supplies. A switch connects the first power supply to a load. As the voltage of that load increases reaching the first power supply level, the switch connects in the next series connected power supply to the load increasing the voltage and the current available to the load. As the voltage increases at the load to the voltage level of the next series connected power supply, the next series connected power supply is switched to the load increasing the voltage and the current available to the load. This switching process continues till the highest voltage level of the series connected power supplies is reached by the load. As the voltage at the load decreases, falling through each next decreasing level, from each successively lower power supply is disconnected.

7 Claims, 2 Drawing Sheets

CURRENT SOURCE WITH SUPPLY CURRENT MINIMIZING

FIELD OF THE INVENTION

This invention relates to switch power supplies providing driving currents.

BACKGROUND OF THE INVENTION

MOSFET or DMOSFET transistors are often used as switches, for example, to connect a load to a power supply. It is often required that the switch be placed in series with the positive terminal of the supply, and that the FET switch be "N" polarity. ("N" channel MOSFETs or DMOSFETs will be henceforth referred to simply as NFETs.)

When an NFET is used as above, the Drain is connected to the supply and the Source is connected to the load. To open the switch, the Gate is placed at or below ground potential. To close the switch, the Gate must be driven positive relative to the Source. As the NFET starts to conduct, the Source becomes positive and approaches the potential of the Drain terminal.

The Gate to Source voltage needed to place the NFET in an acceptably low resistance on state is higher than the Drain to Source voltage that results from being in that on state. The Gate terminal must therefore be driven higher than the Drain, or positive supply. A second supply must therefore be provided that is at higher potential than the primary supply.

The second supply is often generated by means of a charge pump. It is often desirable that the charge pump use capacitors that are internal to an integrated circuit. Due to the limited size of internal capacitors, this results in a supply of limited capability.

SUMMARY OF THE INVENTION

This invention automatically switches a load, such as an NFET Gate, to the lowest voltage supply that is capable of supporting the load voltage. If the load voltage is below that of the primary supply, the load current will be sourced from that primary supply. If the load voltage increases so it is at or about the primary supply, the invention switches to a secondary, higher voltage supply to source the load current. This switching is automatic and reversible: if the load voltage decreases to be below the primary supply voltage, the invention will switch back to the primary supply as the load source.

DESCRIPTION OF PREFERRED EMBODIMENT

Figure 1:
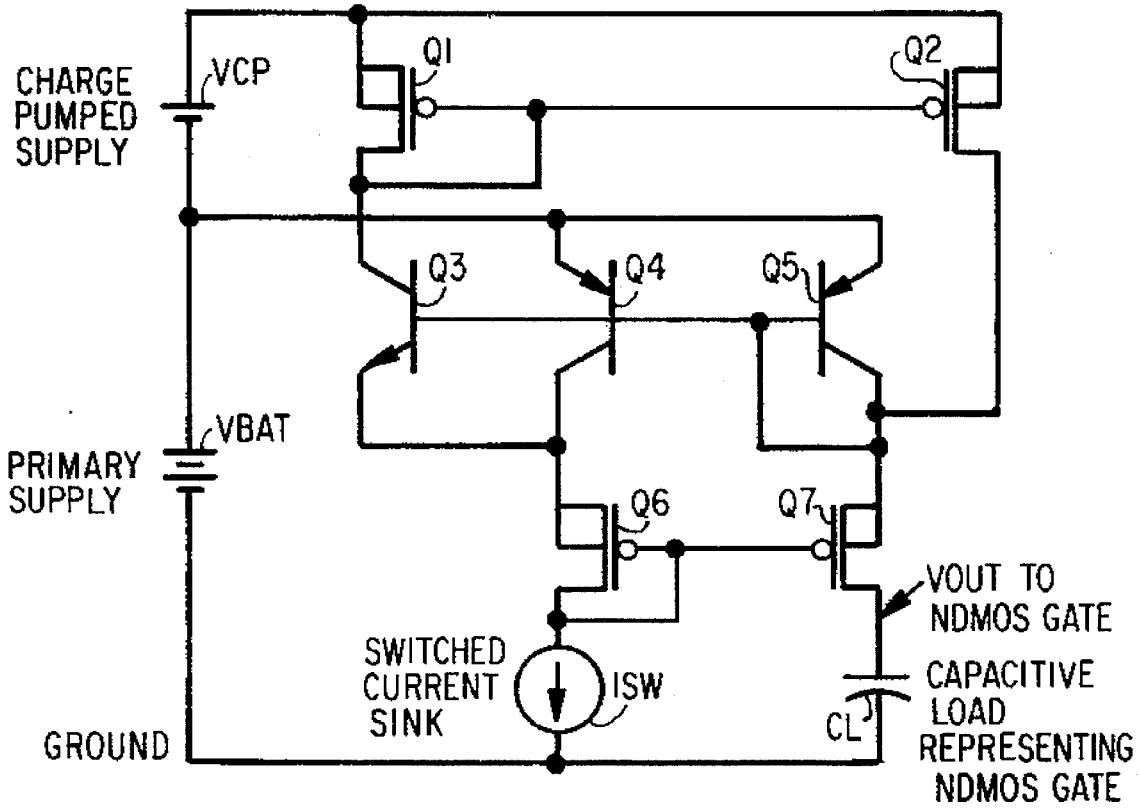
FIG. 1 shows the inventive concept using two power supplies, VBAT and VCP.

This invention is shown generally in FIG. 1. As shown, a drive circuit, comprising $Q_1$, $Q_2$, $Q_3$, $Q_4$, $Q_5$, $Q_6$, $Q_7$, and a controlling input current ISW is connected to a primary supply VBAT, a secondary supply VCP, and to a load, shown as the gate of an NDMOS in the preferred embodiment and represented as a Capacitive Load (CL) at terminal 11. As would be understood by those skilled in the art, this invention is not limited to the use of driving an NDMOS but may be used with any load. The object of the drive circuit shown in FIG. 1 is to source current to the load CL from the primary VBAT supply or from the successively arranged supply VCP to progressively add to the potential applied to the load CL. This is accomplished by switching $Q_7$ into conduction.

Accordingly, when the voltage output to the load, shown in the preferred embodiment as the NDMOS Gate CL, approaches VBAT, the full capability of the primary supply, the drive circuit is switched to the successively placed supply shown as charge pumped supply VCP whose higher voltage is then added to VBAT and used to source the load current.

As shown, a controlling input current "ISW" is connected to the gates of $Q_6$ and $Q_7$. In the preferred embodiment $Q_1$, $Q_2$, $Q_6$, $Q_7$ are PMOSFETS, $Q_3$ is an NPN and $Q_4$ and $Q_5$ are PNP transistors.

As shown, the Base and Collector of $Q_5$ (in the preferred embodiment shown as a PNP) are shorted together. $Q_5$ therefore operates as a diode with its anode connected to VBAT. $Q_4$ has its Emitter and Base connected to the like terminals of $Q_5$ and thus has the same Emitter to Base voltage as $Q_5$. Current drawn through $Q_5$ from Emitter to Collector sets up a reference voltage across the Emitter to Base of $Q_4$, thus causing $Q_4$ to also conduct from Emitter to Collector. The ratio of the current through $Q_4$ to the current through $Q_5$ is the same as the ratio of the size of $Q_4$ compared to $Q_5$. This is a well known current mirror configuration.

ISW draws current from and reduces the voltage at the Drain of $Q_6$ and the Gates of $Q_6$ and $Q_7$, thus driving them into conduction. As a result, $Q_7$ connects $Q_5$ Base and Collector to the load terminal 11. If the load potential is at least a diode drop lower than VBAT, current is drawn from VBAT through $Q_5$ through $Q_7$ to the load. A second current flows from VBAT through $Q_4$ through $Q_6$ to ISW. The current through $Q_6$ balances ISW and acts as a negative feedback: If the load current were to increase further, the current through $Q_4$ would also increase, become greater than ISW, and tend to pull up on $Q_6$ and $Q_7$ Gates and turn them off. This is also a well known mirror configuration. The load current ICL will ratio to ISW as the ratio of the size of $Q_5$ to $Q_4$.

If the ratio of $Q_6$ size to $Q_7$ size is the same as the ratio of $Q_4$ size to $Q_5$ size, $Q_6$ will have the same Gate to Source voltage as $Q_7$, As the Gate of $Q_6$ is connected to the Gate of $Q_7$, the Source voltage of $Q_6$ must equal that of $Q_7$, As the Source of $Q_6$ is connected to the Emitter of $Q_3$ and the Source of $Q_7$ is connected to the Base of $Q_3$, there is no Base to Emitter voltage at $Q_3$ and $Q_3$ will not conduct.

The source to drain voltage of $Q_7$ is equal to the primary supply voltage, VBAT minus the base to emitter voltage of $Q_5$ ($V_{beq5}$), minus the load voltage at terminal 11. As the voltage at terminal 11 increases, the source to drain voltage of $Q_7$ decreases. This source to drain voltage may only decrease to a point determined by the on state resistance of $Q_7$ and current to the Load CL. Any further increase in voltage at terminal 11 will decrease the base to emitter voltage $V_{be}$ of $Q_5$ and $Q_4$, and $Q_4$ will no longer be capable of carrying ISW.

If $Q_4$ can no longer carry ISW, the collector to emitter voltage across $Q_4$ increases. As a result, the base to emitter voltage of $Q_3$ increases biasing it into conduction. $Q_3$ conducts ISW current from the drain of $Q_1$, thus reducing the voltage at the gate of $Q_1$ and $Q_2$, placing $Q_1$ and $Q_2$ into conduction. $Q_2$ driven into conduction connects the charge pumped supply VCP through $Q_2$ to $Q_7$ and to the load CL. $Q_1$ and $Q_2$ operate as a current mirror shown with source and gate terminals connected, respectively. As Vout to the load CL increases further, the base to emitter voltage of $Q_4$ and $Q_5$ collapses increasing the portion of ISW current flowing through $Q_3$, $Q_1$, and $Q_2$, and $Q_7$ until $Q_4$ and $Q_5$ are cut off and all the ISW current flows through $Q_3$, $Q_1$, $Q_2$ and $Q_7$ to the load. At this point, the higher voltage supply of VCP in series with VBAT is sourcing all the current to the load CL.

A further increase in Vout to the load CL causes the base to emitter junctions of $Q_4$ and $Q_5$, ($V_{beq4}$, $V_{beq5}$), to reverse bias. $Q_2$ can continue to source current until Vout increases to VCP minus the required on state drop across $Q_2$.

Figure 2:
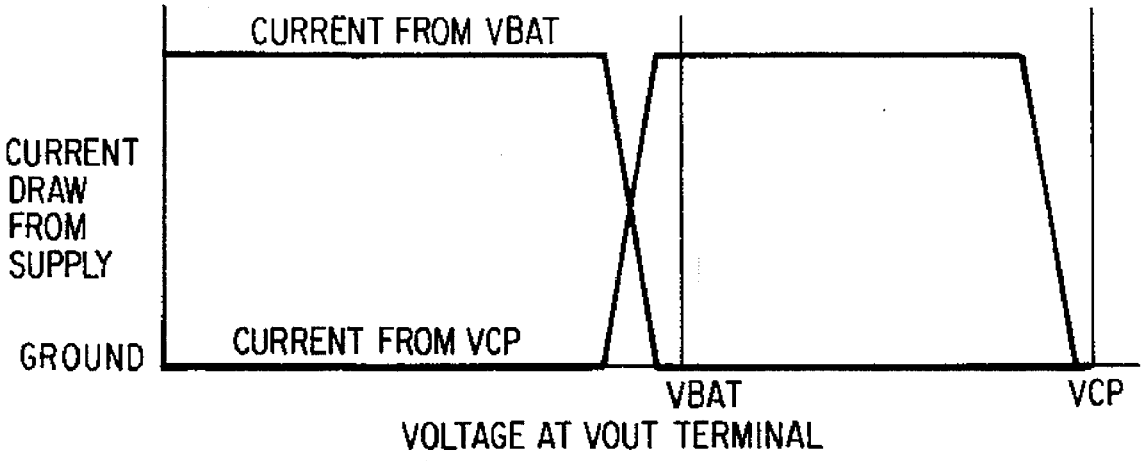
FIG. 2 shows the changing current from the VBAT and VCP shown in FIG. 1, as the voltage at V OUT TERMINAL increases to the VBAT.

As explained above, as the current through $Q_7$ increases, increasing the voltage to the load CL, Vout will reach a level approximately that of the primary supply VBAT minus the voltage drop across the base to emitter junction of $Q_5$, $V_{BEQ5}$. As current is supplied to the Load, CL, through $Q_5$, the voltage on the Load, CL, will increase, reducing $V_{BEQ5}$ and turning it off. This is as shown in FIG. 2 where the current from VBAT to the load begins to decrease. At this point, the bias to $Q_4$ is reduced turning $Q_4$ off. As a consequence, the collector voltage across $Q_4$ decreases forward biasing $Q_3$, $Q_3$ conducts ISW current through the $Q_1$ which is mirrored to $Q_2$ producing ISW current through $Q_7$ and to CL. The voltage at CL will be approximately VBAT+VCP−$V_{BEQ2}$(the source to drain voltage drop across $Q_2$).

Figure 3:
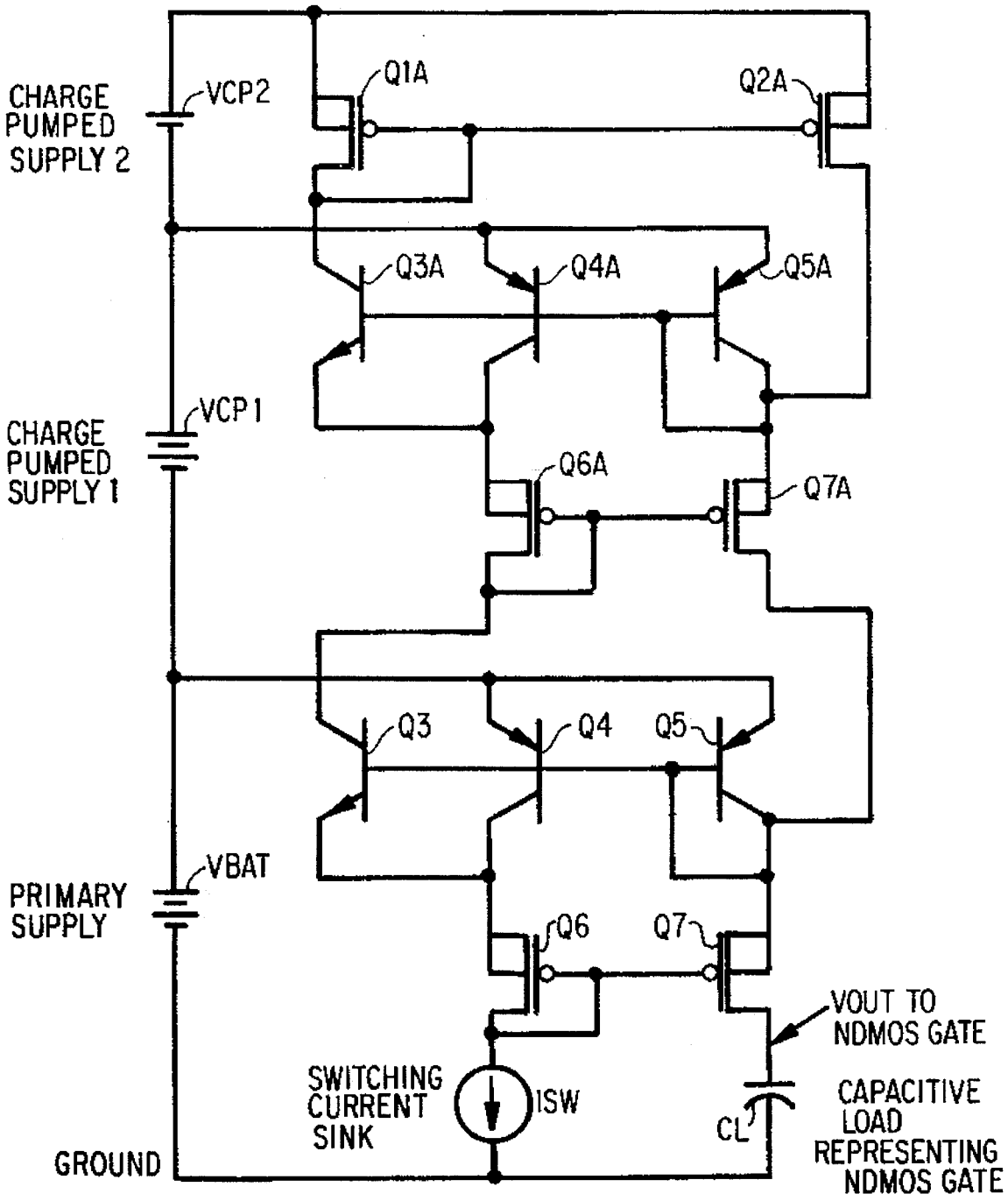
FIG. 3 shows the inventive concept is shown in FIG. 1 with series connected power supplies VCP 1 and VCP 2.

FIG. 3 shows a variation of the preferred embodiment, shown in FIG. 2. In FIG. 3, two charge pumped supplies are cascaded or successively connected to the primary supply, shown as Charge Pumped Supply 1 and Charge Pump Supply 2. Load current is sourced from VBAT until the voltage at the load begins to rise above $V_{BAT}$−$V_{BE\ Q5}$, as explained above. At this point, $Q_5$ begins to turn off turning off $Q_4$ as described above and turning $Q_3$ on. $Q_3$ carrying the full ISW current will pull down the gates of $Q_{6A}$ and $Q_{7A}$ turning them on and causing current to flow through $Q_{7A}$ to the Load in the same as described in reference to FIG. 1. As the voltage across the Load begins to rise above VCP1+VBAT−$V_{BE\ Q5A}$, $Q_{5A}$ will turn off, as described above with regard to $Q_5$, turning off $Q_{4A}$ and turning on $Q_{3A}$, as described above with regard to $Q_3$. This will turn on the current mirror of $Q_{1A}$ and $Q_{2A}$ and additional current will be supplied to the source through $Q_{2A}$ and $Q_7$ to increase the voltage at CL to approximately VCP2+VCP1+VBAT.

This scheme can be expanded to "N" number of VCPS.

In this way, the cascaded charge pump supplies VCP1, VCP2 to VCPN will be switched in automatically and successively as the Load CL successively reaches VBAT to VBAT+VCP1, to VBAT+VCP1+VCP(N−1).

As shown in FIG. 2, at switching, the current from the charge pump supply VCP1 will begin to rise while the current from the primary supply will decrease reaching 0. The current from the charged pump supply would reach 0 as the voltage of the output terminal approaches its maximum voltage. Where cascaded supplies are used, VCP1, VCP2... VCPN, the current from each active supply, VCP(N−1) for example will decrease to 0 as the next supply VCPN for example is switched to the load.

In the preferred embodiment $Q_1$ is matched to $Q_2$, $Q_4$ is matched to $Q_5$ and $Q_6$ is matched to $Q_7$. This matching condition produces a current to the load equal to the control current ISW. However, the invention is not restricted to this matching condition. As would be understood by those skilled in the art, while current is being drawn from the supply the VBAT, for example the load current is ratioed to the control current ISW in the same ratio as $Q_5$ to $Q_4$. Accordingly, the current through $Q_6$ is in the ratio to $Q_7$ as the ratio of the current through $Q_4$ is to $Q_5$. When load current is drawn from the second supply, VCP1 for example, the current to the load CL is in the ratio to current ISW as the current through $Q_2$ is to the current through $Q_1$. This permits automatic switching of cascaded power supplies responsive to the voltage across the Load CL.

As would be understood by those skilled in the art, the eventful principals are not limited to the polarities of the supplies or the transistors and FET shown in the preferred embodiment. For example, if the supply polarities could be reversed with NPN transistors substituted for PNP transistors, PNP transistors substituted for NPN transistors, and with NMOSFETS substituted for PMOSFETS.

I claim:

1. A cascaded switched power supply, comprising:

a set of series connected power supplies numbered in ascending order 1, 2, 3, - - - N;

a set of cascaded switches numbered in ascending order 2, 3, - - - N, for each of said respective series connected power supplies;

each said cascaded switch 2, 3, - - - N, successively operated to connect a respective series connected power supply 2, 3, - - - N, to said load;

each said cascaded switch, 2, 3, - - - N successively operated to disconnect a previously series connected power supply from said load and to connect said disconnected power supply in series with said respective power supply;

each said cascaded switch including a current mirror for supplying current from said respective series connected power supply to said load;

each said cascaded switch including a current source connected to said current mirror and responsive to decreasing current through said current mirror for disconnecting a respective series connected power supply connected to said a load by a cascaded switch and for operating a next cascaded switch, to connect the next series connected power supply to said load.

2. The cascaded switched power supply of claim 1, wherein:

said current mirror includes a pair of MOSFETs and a pair of bipolar transistors.

3. The cascaded switched power supply of claim 1, wherein:

said current source is a transistor with the base and emitter of said transistor connected to the base and collector of a transistor in said current mirror; and said transistor is arranged to conduct to operate said next cascaded switch in response to decreasing current in said transistor in said current mirror.

4. The cascaded switched power supply of claim 2, wherein:

said transistor and said transistor in said current mirror are different polarities.

5. The cascaded switched power supply of claim 4 where said transistor is an NPN transistor and said transistor in said current mirror is a PNP transistor.

6. A switched power supply comprising a first power supply having a first voltage level;

second power supply having a second voltage level and connected in series with said first power supply;

a load;

a control means for connecting said first power supply to said load;

said control means including means for detecting the voltage at said load;

said control means being responsive to said means for detecting said voltage at said load at a first defined level, for connecting said second power supply to said load in series with said first power supply;

said defined voltage level at said load is the first power supply voltage reduced by the voltage drop across said control means;

said control means connecting said first power supply to said load when said voltage at the load is below said defined level;

said control means reducing the current to said load from said first power supply in response to said voltage at the load rising above said first defined level;

said control means increasing the current from said second power supply, in series with said first power supply, to said load in response to said voltage at said load rising above said first defined level; and said control means decreasing said current to said load from said second power supply in response to said voltage rising to a second defined level.

7. The switched power supply of claim 6 wherein:

said second defined voltage level is the voltage level of said second power supply and said first power supply in series reduced by the voltage drop across the control means.

* * * * *